235-381 SR
DR 4,030,071

United Sta[redacted]

Barker

[11] 4,030,071
[45] June 14, 1977

[54] ELECTRICALLY OPERATED LOCKING MECHANISM

[76] Inventor: Herbert J. Barker, 6009 Rising Sun Ave., Philadelphia, Pa. 19111

[22] Filed: Apr. 22, 1976

[21] Appl. No.: 679,247

[52] U.S. Cl. ..... 340/164 R; 340/274 C; 340/149 A; 340/147 MD

[51] Int. Cl.[2] ..... G08B 13/08

[58] Field of Search ... 340/274 C, 149 A, 147 MD, 340/164 R; 307/10 AT; 317/134

[56] References Cited

UNITED STATES PATENTS 3,717,866 2/1973 Ehrlich ..... 340/147 MD

*Primary Examiner*—Harold I. Pitts

*Attorney, Agent, or Firm*—Zachary T. Wobensmith, III; Zachary T. Wobensmith, 2nd

[57] ABSTRACT

The present system provides a key device which, when fitted into a key receptacle, connects a certain number of electrical circuit terminals so that certain necessary relay circuits, connected to said terminals, are energized whereby a circuit to energize a solenoid and thereby open a lock is completed through a relay tree provided that certain interrupt relays remain unenergized. If the wrong key device is used, the necessary relay circuits will not be energized and one or more of the interrupt relays may be energized whereby the lock solenoid will not be energized and an alarm may be turned on. The system further provides a power failure means which accepts a mechanical key and when the mechanical key has passed the proper tumblers, the lock solenoid will be energized.

11 Claims, 3 Drawing Figures

ELECTRICALLY OPERATED LOCKING MECHANISM

BACKGROUND OF THE INVENTION

1. Field of the Invention

Electro-mechanical key arrangements are well known in the art, and heretofore have taken the form of a mechanical key type device which is physically shaped, or formed, so that when it is inserted into the lock receptacle it will physically close a plurality of electrical lines (i.e., make a plurality of contacts). The closing of these electrical lines will provide an electrical logic circuit which will provide electrical power to an electro-mechanical device, such as a solenoid, to open a lock. Normally the bolt on the lock is spring-loaded and will return to the locked position when the key is removed or the electrical energy is terminated for some other reason.

As illustrative of prior locking systems which have been proposed reference may be had to the U.S. Pat. Nos. to Watson, 1,695,518; Block, 2,006,624; Durant, 3,148,525; Taylor, 2,473,664; Rose, 3,347,072; Christensen, 3,355,631; Swannick, 3,411,046; Kramasz, et al., 3,415,087; Isserstedt, 3,654,522, and Bostrom, 3,686,659.

The above described mechanisms, or systems, have been satisfactory up to a point but have been unsatisfactory if there was a power failure, or if the lock had to be changed to thwart the use of a key by some unauthorized person, or if the user wanted an alarm sounded when a wrong key was inserted.

SUMMARY OF THE INVENTION

The present system employs a male key device which has a plurality of pins or prongs protruding therefrom. Some of the male pins are interconnected within the housing of the key device. The male key device is fitted into a female receptacle which has a plurality of sockets or receptacles into which the pins or prongs of the male device fit. Certain of the sockets are interconnected within the housing of the female receptacle.

The sockets are also connected, according to a plan, to the coil points and transfer straps of a plurality of relays as well as to a power source. When the power is applied to the female receptacles and the proper male key device is inserted, certain relays of a group of relays will be energized while certain other relays will not be energized. An ohmic path through the energized and unenergized relays will be formed. Said ohmic path will connect a power source with a solenoid to energize the solenoid. The solenoid is mechanically coupled to a bolt in a lock so that when the solenoid is energized, the bolt will be pulled back from the bolt receptacle to unlock the door or other device.

If one of the relays which is intended to be left unenergized becomes energized then the ohmic path is broken, or will not be completed, and the solenoid will not be energized. On the other hand, if some of the relays which should be energized fail to become energized, then said ohmic path will not be completed and the solenoid will not be energized. The system further provides an emergency power source which is connected through a mechanical locking means to the solenoid. If the power company power source fails, the user can employ a mechanical key to connect in the emergency power source to the solenoid, however, if the power company power does not fail, the mechanical key is ineffective even if it is used. Actually, when the group of relays is energized there is a second electrical path formed which provides a means for energizing others of said relays and this path can also be interrupted by improper key connections.

The present system permits the user to readily change the "combination" for the key device which would be analgous to changing the tumblers in a mechanical lock and providing a new set of keys.

BRIEF DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Figure 1:
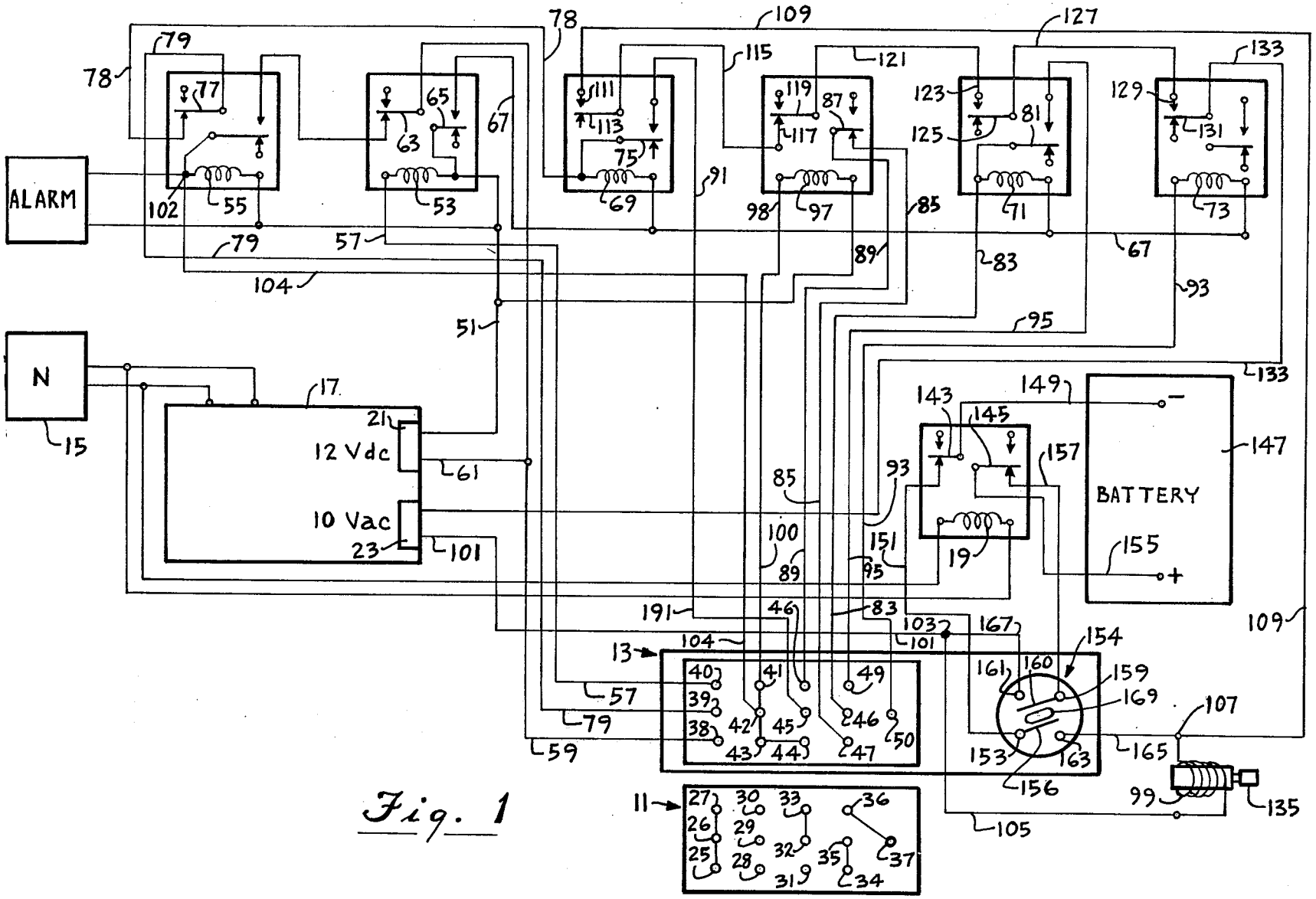
FIG. 1 is a schematic of the key and relay circuits.

Referring now more particularly to the drawings FIG. 1 shows a schematic diagram of the male key device 11, the female receptacle 13 and the relay logic. The system is connected to a power company power source 15. The power source 15 supplies 110 volt – 60 cycle power to the transformer-rectifier 17 as well as to the relay coil 19. Other power values could be supplied and employed without detracting from the invention. The transformer-rectifier 17 accepts the 110 volt – 60 cycle power and at one set of output terminals 21, provides a 12 volt d.c. power source while at a second output terminals 23, provides a 10 volt, a.c. power source.

Figure 3:
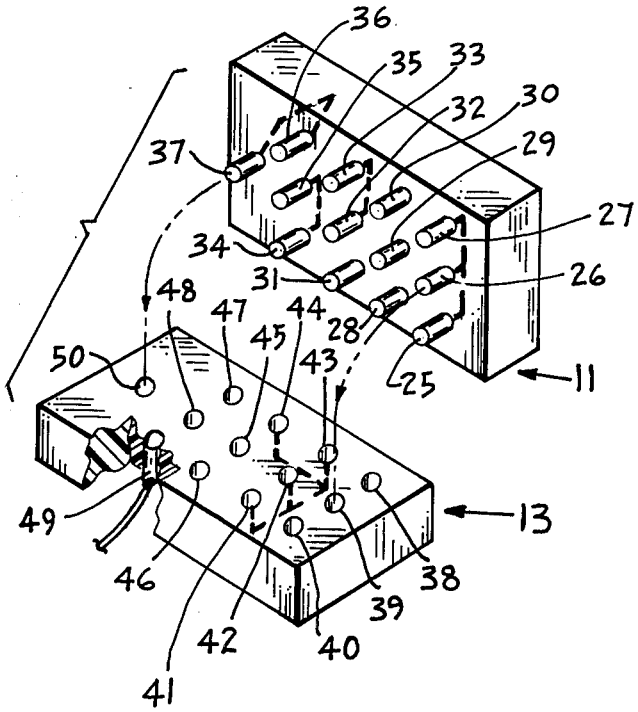
FIG. 3 depicts the interconnection of the key device and key receptacle device.

Before considering the operation of the relay logic reference may be had to FIG. 3 which is a pictorial view of the male and female halves of the key device. In FIG. 3 the male key device 11 has thirteen apertures 25 through 37 located therein, while the female device has a plurality of apertures 38, through 50 located therein. In each of the apertures 25 through 37 there is located a prong with a hollow section at its upper end. Each prong is formed to be spread, once it is inserted into an aperture, to provide a firm fit into its associated aperture. Each of the apertures 38 through 50 has a hollow, sleeve-like, receptacle which can receive a prong and make a wiping contact between said prong and the sides of the hollow receptacle. The female receptacles are press-fitted into the female receptacle housing.

As can be seen in FIG. 3, there is a wire connecting the prongs in apertures 25, 26 and 27. These connections can be seen in FIG. 1. Also in FIG. 3 it can be seen that the prongs in apertures 32 and 33 are connected; the prongs in apertures 34 and 35 are connected; and the prongs in apertures 36 and 37 are connected. These connections can also be seen in FIG. 1. In FIG. 3, also, the receptacles in apertures 41, 42, 43 and 44, of the key receptacle device 13 are connected together. These connections can be seen in FIG. 1. Other connections can be readily made by simply interconnecting the male prongs of key 11 and the receptacles of key receptacle 13 in some other configuration than that shown in FIG. 3 and FIG. 1.

When the key 11 is inserted into the key receptacle housing 13, the receptacles of apertures 38, 39 and 40 are connected together through the male key jumpers as are the receptacles of apertures 45 and 46, 47 and 48, and 49 and 50. Consider that the key 11 is inserted into the key receptacle housing 13 and that the power from source 15 is supplied.

One output line 51 from the 12 volt d.c. supply, is connected to the relay coils 53 and 55. The other side of the coil 53 is connected by line 57 to the receptacle in aperture 40. Since the receptacle in aperture 40 is connected to the receptacle in aperture 38 by virtue of the connection between the prongs in aperture 25 and 27, the line 57 is connected to line 59. Line 59 is connected to line 61 and to transfer strap 63. Line 61 is connected to the other side of the 12 volt d.c. supply. Accordingly when the key 11 is inserted, the relay coil 53 is energized. However, it should be noted that while the 12 volt d.c. power is applied to coil 55, the second side of coil 55 is not connected to line 61 and therefore the coil 55 is not energized.

When the coil 53 is energized, the transfer straps 63 and 65 are transferred. When the point 65 is transferred, the line 51 is connected to line 67, hence the 12 volt d.c. supply is provided to the first sides of relay coils 69, 71 and 73.

If we examine the coil 69 we find the second side of the coil 69 is connected to transfer strap 75 and to transfer strap 77. The transfer strap 77 is connected to line 79 which is connected to the receptacle in aperture 39. As previously pointed out the receptacle in aperture 39 is connected to the receptacle in aperture 38 which is connected via lines 59 and 61 to the other side of the 12 volt d.c. supply. Hence it becomes apparent that when the relay 53 is energized, the relay 69 becomes energized through the transfer strap 77 of the unenergized relay 55.

Relay coil 71 has its second side connected to transfer strap 81 and to line 83. Line 83 is connected through the receptacle in aperture 48, the prong in aperture 35, the jumper connected to the prong in aperture 34, the receptacle in aperture 47, line 85, transfer strap 87, line 89, through the receptacles in apertures 46 and 45 (by virtue of the jumper across the prongs in apertures 33 and 32), through line 91, through transfer strap 75, to line 78, through transfer strap 77, along line 79, and as previously described to line 61, the other side of the 12 volt D.C. supply. Hence when the relay 69 is energized and the transfer strap 75 is transferred, the relay 71 is energized. It should also be noted that the relay coil 71 will not be energized if the prongs in apertures 34 and 35 and in apertures 32 and 33 are not connected as shown in FIGS. 1 and 3.

The second side of relay 73 is connected to line 93, through the receptacles in apertures 50 and 49 (by virtue of the connection of the prongs in apertures 36 and 37 of the male key), along line 95 to the transfer strap 81. Bear in mind that we have just studied how the relay 71 was energized so that the transfer strap 81 is connected to line 95. This circuit path from the transfer strap 81 back to line 61 is identical to the one described with respect to energizing relay 71. Hence it becomes apparent that when relay 71 is energized, relay 73 becomes energized. Thus far we have seen that when the key device 11 is inserted into the key receptacle 13, the relays 53, 69, 71 and 73 are energized, while the relays 55 and 97 have not been energized. The purpose, of course, in energizing said relays is to provide an ohmic path (a relay tree path) to the solenoid 99. Accordingly, let us trace out the path from the 10 volt a.c. source 23.

The 10 volt a.c. source 23 is connected by line 101 to point 103, downward along line 106 to the solenoid 99. The other side of the solenoid 99 is connected to point 107, thereafter along line 109 to relay point 111. Since relay 69 has been energized, transfer strap 113 will be connected to relay point 111 and the path from solenoid 99 will continue along line 115, through normally closed relay point 117, transfer strap 119 and line 121 to normally open relay point 123. Since both relays 71 and 73 are energized the respective transfer straps 125 and 131 have been transferred to connect respectively with the normally open relay points 123 and 129. Hence the path from solenoid 99 continues through relay point 123, through transfer strap 125, along line 127, through normally open relay point 129, through transfer strap 131, along line 133, back to the 10 volt a.c. source 23. Accordingly, it can be seen that when relays 53, 69, 71 and 73 are energized and relays 55 and 97 are not energized the solenoid 99 will be energized.

Figure 2:
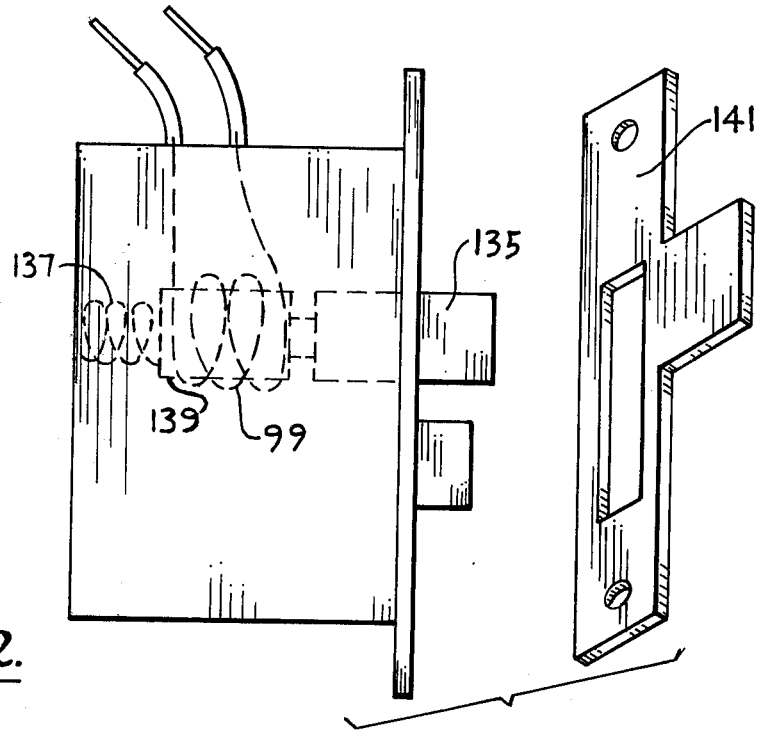
FIG. 2 is a pictorial of the mechanical lock coupled to a solenoid.

When the solenoid 99 is energized its movable core is retracted to move the bolt 135 out of the lock. Bear in mind that the solenoid could move the bolt the other way by rearranging the core. The solenoid 99 and the bolt 135 can be better seen in FIG. 2. In FIG. 2 solenoid 99 is shown in phantom and the bolt 135 is shown in its locking position. The solenoid 99 as shown in FIG. 2 is in the unenergized mode. The movable core of solenoid 99 is shown spring-loaded by spring 137 which fits on the flange 139. It should be understood that other forms of spring loading could be employed. The bolt 135 fits into the door receptacle 141.

When the power from source 15 is applied to the system relay 19 is energized directly. When the relay 19 is energized the transfer straps 143 and 145 are transferred and hence no electrical energy can pass through the points of the energized relay 19.

However, if the power from source 15 fails, the relay 19 will drop out and the transfer straps 143 and 145 will assume the position shown in FIG. 1. Therefore voltage will be applied from the negative terminal of battery 147, along line 149, through transfer strap 143, along line 151 to terminal 153 of mechanical lock 154. At the same time voltage is applied from the positive side of battery 147, along line 157 to terminal 159 of the mechanical lock 154.

If there has been a power failure and the user needs to open the door or other device, he inserts a properly fitting mechanical key into slot 169 and turns the lock 154. When the lock 154 turns the transfer strap 160 connects terminals 159 and 161 and the transfer strap 156 connects terminals 153 and 163. Thereafter the voltage applied to terminal 159 is applied through transfer strap 160 to terminal 161, through point 103 and line 105 to solenoid 99. At the same time the voltage applied to terminal 153 is applied through strap 156, through terminal 163, along line 165 to terminal 107 and the other side of solenoid 99.

It should be apparent that if there is a power failure, a key may be inserted in lock 154 and after the lock 154 is turned, the emergency battery power will energize the solenoid 99.

Let us consider what happens if the wrong key is inserted into the key receptacle 13. If the receptacles in aperture 47 and 48 are not connected by the key then relay 71 will not be energized and the solenoid 99 cannot be energized. Accordingly if the wrong key does not have the prongs in apertures 34 and 35 connected, the solenoid 99 will not be energized. In a very similar manner if the receptacles in apertures 49 and 50 are not connected through the male key, relay 73 will not be energized and solenoid 99 will not be energized. Further it should be noted that if the receptacles in apertures 40 and 38 are not connected, relay 53 will not be energized and if relay 53 is not energized the relays 69, 71 and 73 cannot be energized even if the key is correctly wired to energize these last mentioned relays. Accordingly four positive conditions must exist in the wiring of the male key in order to energize solenoid 99 and those are the conditions to energize relays 53, 69, 71 and 73. In addition two negative conditions must exist. The key cannot be wired to energize either relay 55 or 97.

If relay 55 is energized then the transfer strap 77 will be transferred and the circuit to energize relay 69, as described above, will be broken. Therefore relay 69 cannot be energized. Quite similarly if relay 97 is energized then neither relays 71 or 73 could be energized because their energization paths are broken by the transfer of transfer strap 87. Further the energization of relay 97 interrupts the energy path to the solenoid 99 because said energy path is through the normally closed point 117 which now would be open.

Let us examine how relays 55 and 97 might be energized. If an authorized key were wired to connect any one of the prongs in apertures 28 through 31 to prong 25, then there would be a direct circuit from terminal 98 along line 100, through the unauthorized jumper in the key to line 59 and line 61. This last described circuit path would enable the relay 97 to be energized and therefore make energizing the solenoid 99 not possible. This same unauthorized wiring in the key would cause relay 55 to be energized by virtue of the connection from terminal 102, along line 104, through the unauthorized jumper to lines 59 and 61. When relay 55 is energized, of course, relay 69 cannot be energized. If relays 55 or 97 are energized a power supply would lock out both relay 55 and 97 until the proper key is inserted to reset the circuits. This supply to relays 55 and 97 would run through line 61 through strap 63 of relay 53 to the normally open side of relay 55.

An alarm circuit is connected in parallel across the relay 55 so that if relay 55 is energized not only will the energization path for relay 69 be interrupted but an alarm will sound. The alarm can be a bell, siren, light or the like.

The requirement of four positive condition connections and two negative condition connections in the key renders the key statistically free from readily being duplicated. However, if a key were to be lost or stolen, the key and receptacle combination could be readily changed and with a very large number of combinations available. The wires from the receptacles could be readily changed around to new locations and the jumpers in the male key device can readily be relocated to properly match the new locations of the receptacle wires.

I claim:

1. An electrically operated lock system comprising in combination solenoid means having a slideable core, means coupled to said slideable core to be moved in response to said solenoid being energized to provide a locking means, key receptacle means having a plurality of portions formed to effect electrical contacts, first jumper means disposed to connect certain of said portions together, first and second groups of relays each having normally open and normally closed relay points and transfer straps associated therewith, said first and second groups of relays having their relay points and transfer straps interconnected with each other and with certain of said portions so that when said first group of relays is energized and said second group of relays is unenergized, there are formed first and second electrical energy paths interrupted only by connection voids between certain of said receptacles, said first electrical energy path providing a means through which electrical energy passes to energize certain relays of said first group, said second electrical energy path providing a means to energize said solenoid, first and second power means, said first power means connected to certain of said portions and to certain of said relays, said second power means connected to said solenoid through said second electrical energy path, key means having a plurality of portions engaging portions of said key receptacle means, second jumper means connecting certain of said portions of said key means whereby when said key means is inserted into said key receptacle means said connection voids have electrical connections thereacross and accordingly power is applied through said key receptacle means to energize said first group of relays to effect an energization of said solenoid through said second electrical energy path.

2. An electrically operated lock system according to claim 1 in which said key receptacle has a plurality of receptacles disposed therein and providing said electrical contacts, and said key means has a plurality of prongs adapted to be inserted into said receptacles.

3. An electrically operated lock system according to claim 1 wherein said first and second power sources are derived from a third power source and there is provided a fourth power source which is formed to provide power in the event of a failure of said third power source and there is further included a controllable relay means having a coil, points and transfer straps whose normally closed points and transfer straps are connected between said fourth source of energy and said solenoid and whose relay coil is connected to said third source of energy whereby when said third source of energy is available said relay coil is energized to prevent said fourth source of energy from being applied to said solenoid.

4. An electrically operated lock system according to claim 3 wherein said controllable relay means further includes a mechanical locking means which is formed to have two transfer straps and two normally open points and formed whereby when said locking means is activated said transfer straps close on said normally open points and wherein each of said normally closed controllable relay points is connected to an associated transfer strap so that when said mechanical lock is activated a circuit will be completed to said solenoid through said last mentioned transfer straps.

5. An electrically operated lock system according to claim 1 wherein certain of said receptacles are interconnected by said first jumper means and are connected to provide an energization path to said second group of relays whereby if said key means has incorrectly located second jumpers energy can be supplied through said interconnected receptacles to energize said second group of relays and thereby interrupt said first and second electrical energy paths.

6. An electrically operated lock system according to claim 5 wherein there is further included an alarm means connected to said second group of relays whereby if said second group of relays is energized said alarm means will be energized.

7. An electrically operated lock system according to claim 1 wherein said solenoid is spring-loaded so that when said solenoid is not energized said bolt will be in a locking position.

8. An electrically operated lock system according to claim 1 wherein said first and second jumper means can be readily moved to respectively connect other receptacles and prongs and wherein the connections of said first power source and said relays to said receptacle can be readily changed to provide a new combination to enable said key means to energize said solenoid.

9. An electrically operated lock system according to claim 1 wherein said key means must provide at least a predetermined number of jumper connections to fulfill said predetermined number of positive conditions for providing said second electrical energy path and wherein said key receptacle means must provide at least a different predetermined number of jumper connections to fulfull said different predetermined number of negative conditions for providing said second electrical energy path.

10. An electrically operated lock system according to claim 1 wherein said relays of said first group are energized serially with each succeeding energized relay depending upon the extension of said first electrical energy path to effect the next energization.

11. An electrically operated lock system according to claim 1 wherein said first group of relays has an initiation relay which must be energized first before said first electrical energy path can be effected.

* * * * *

UNITED STATES PATENT OFFICE

CERTIFICATE OF CORRECTION

Patent No. 4,030,071 Dated June 14, 1977

Inventor(s) Herbert J. Barker

It is certified that error appears in the above-identified patent and that said Letters Patent are hereby corrected as shown below:

Column 4

Line 7, after "line","106" should be - 105 - .

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*